United States Patent [19]

Smith

[11] 4,230,559

[45] * Oct. 28, 1980

[54] APPARATUS FOR PNEUMATICALLY SEPARATING FRACTIONS OF A PARTICULATE MATERIAL

[75] Inventor: William C. Smith, West Vancouver, Canada

[73] Assignee: Rader Companies, Inc., Portland, Oreg.

[ * ] Notice: The portion of the term of this patent subsequent to Aug. 28, 1996, has been disclaimed.

[21] Appl. No.: 962,951

[22] Filed: Nov. 22, 1978

Related U.S. Application Data

[63] Continuation of Ser. No. 876,131, Feb. 8, 1978, Pat. No. 4,166,027, which is a continuation of Ser. No. 738,635, Nov. 3, 1976, abandoned.

[51] Int. Cl.[3] ..... B07B 4/02

[52] U.S. Cl. ..... 209/139 R; 209/149

[58] Field of Search ..... 209/136–139 R, 209/140, 141, 149, 154, 26–29, 34–37, 132, 133

[56] References Cited

U.S. PATENT DOCUMENTS

| | | | |
|---|---|---|---|
| 1,854,209 | 4/1932 | McLean | 209/139 R |
| 2,000,181 | 5/1935 | Lessing et al. | 209/139 R |
| 2,257,552 | 9/1941 | Hammack | 209/139 R |
| 3,397,782 | 8/1968 | Kwong et al. | 209/477 |
| 3,441,131 | 4/1969 | Gebauer | 209/3 |
| 3,655,043 | 4/1972 | Wochnowski et al. | 209/138 |

*Primary Examiner*—Ralph J. Hill

*Attorney, Agent, or Firm*—Klarquist, Sparkman, Campbell, Leigh, Hall & Whinston

[57] ABSTRACT

A pneumatic material separator having adjacent generally vertical sorting ducts and a generally vertical discharge duct communicating with the tops of the sorting ducts is disclosed. Particulate material introduced into a first sorting duct is separated by an upwardly moving column of gas into an upwardly moving lighter fraction and a downwardly moving heavy fraction. The lighter fraction is carried to a position over a second sorting duct where the gas velocity is reduced. The heaviest particles of the lighter fraction fall into the second sorting duct while the remainder of the lighter fraction is discharged through the discharge duct.

4 Claims, 2 Drawing Figures

APPARATUS FOR PNEUMATICALLY SEPARATING FRACTIONS OF A PARTICULATE MATERIAL

This is a continuation of application Ser. No. 876,131, filed Feb. 8, 1978, now U.S. Pat. No. 4,166,027, dated Aug. 28, 1979, which is a continuation of application Ser. No. 738,635, filed Nov. 3, 1976, now abandoned.

BACKGROUND OF THE INVENTION

This apparatus relates generally to particle separation and more particularly to the separation of particulate material through the use of upwardly moving streams of air or other gas.

The classification of particulate material according to density and/or aerodynamic properties by passing the particulate mixture through zones of differing air velocity has been known and practiced for a number of years. Air classification systems have been used for removing rocks or other foreign matter from such commodities as wheat, tea, raisins, wood chips and the like. A primary separation of light from heavy materials is an exceedingly important first step in the handling of heterogeneous particulate material. Because of the increasing cost of energy and raw materials the efficiency of this first separation step may be critical in determining the overall cost efficiency of a materials handling system.

Recently, compliance with environmental restrictions has necessitated the recycling of municipal garbage and industrial waste which in many cases are collected without discrimination and contain a diverse mixture of heavy materials such as glass, metal and stones, and of lightweight materials such as paper, leaves and plastic. It is advantageous to separate lightweight from heavyweight materials since in most instances, the lightweight material is combustible and thus usable as a source of energy if separated from the heavier materials.

A variety of different apparatuses have been proposed to perform particle separation. The efficiency of these prior art separators has been limited by features which were heretofore considered necessary for a successful separation process. Some of these apparatuses include complex duct arrangements to create turbulences in the material-bearing gas stream and thereby to improve material separation. Such designs are expensive to construct. Also, because of the high turbulence they create, a relatively great amount of energy is invested in moving a gas column through the tortuous ducts.

In other devices a stream of air moves upward in an essentially uninterrupted, straight column. A plurality of outlets on one side of the column are provided for materials to fall through according to their density. If, however, materials of any density or aerodynamic property migrate to the outlets of such a device, they fall through the outlets. The efficiency of separation is low because particles of low density and low aerodynamic characteristics will be carried out through outlets provided for the collection of denser or more aerodynamic particles.

In still other apparatuses heterogeneous material is carried into a series of columns having upwardly moving gas in each column. Because each column in the series contains gas moving upward at a velocity lower than that of the preceeding column, only those particles having the desired density or aerodynamic properties can fall through to the base of each column. Although the accuracy of separation in such devices is good, the operating costs have been relatively high since they have included numerous fans to be driven and many zones of high turbulence where particulate material and/or gas must reverse direction.

SUMMARY OF THE INVENTION

It has now been discovered that a highly efficient separation of heavy and light particles may be conducted at a relatively low energy consumption by feeding the heterogeneous material into columns of air which move continuously upward in substantially vertical ducts.

Particulate material is fed into a first upward moving column of air having a velocity such that a buoyant fraction of the material is raised in the column and a dense fraction falls through the column. The first column of air is deflected toward and merged into a second upward moving column of air displaced horizontally from the first column. For maximum flexibility, the apparatus for this operation is designed such that the velocity of air in each column may be adjusted independently.

An object of this invention is to provide a particle separation system wherein all gas streams move in the same general direction whereby streams which merge do so at a small acute angle, to reduce turbulence and thereby to reduce the amount of energy required to move such gas streams.

Another object of the invention is to provide a simple apparatus which may be constructed inexpensively from a minimum of materials.

Still another object is to provide a separation system wherein a ratio of gas velocities in each of several ducts may be easily adjusted over a wide range.

A further object is to provide a system whereby there are multiple zones for sorting material and yet where efficient sorting occurs at each zone due to the presence of an updraft moving through each outlet duct.

Another object is to provide separating system having a single means for producing multiple upwardly moving columns of air.

DESCRIPTION OF THE PREFERRED EMBODIMENT

Figure 1:
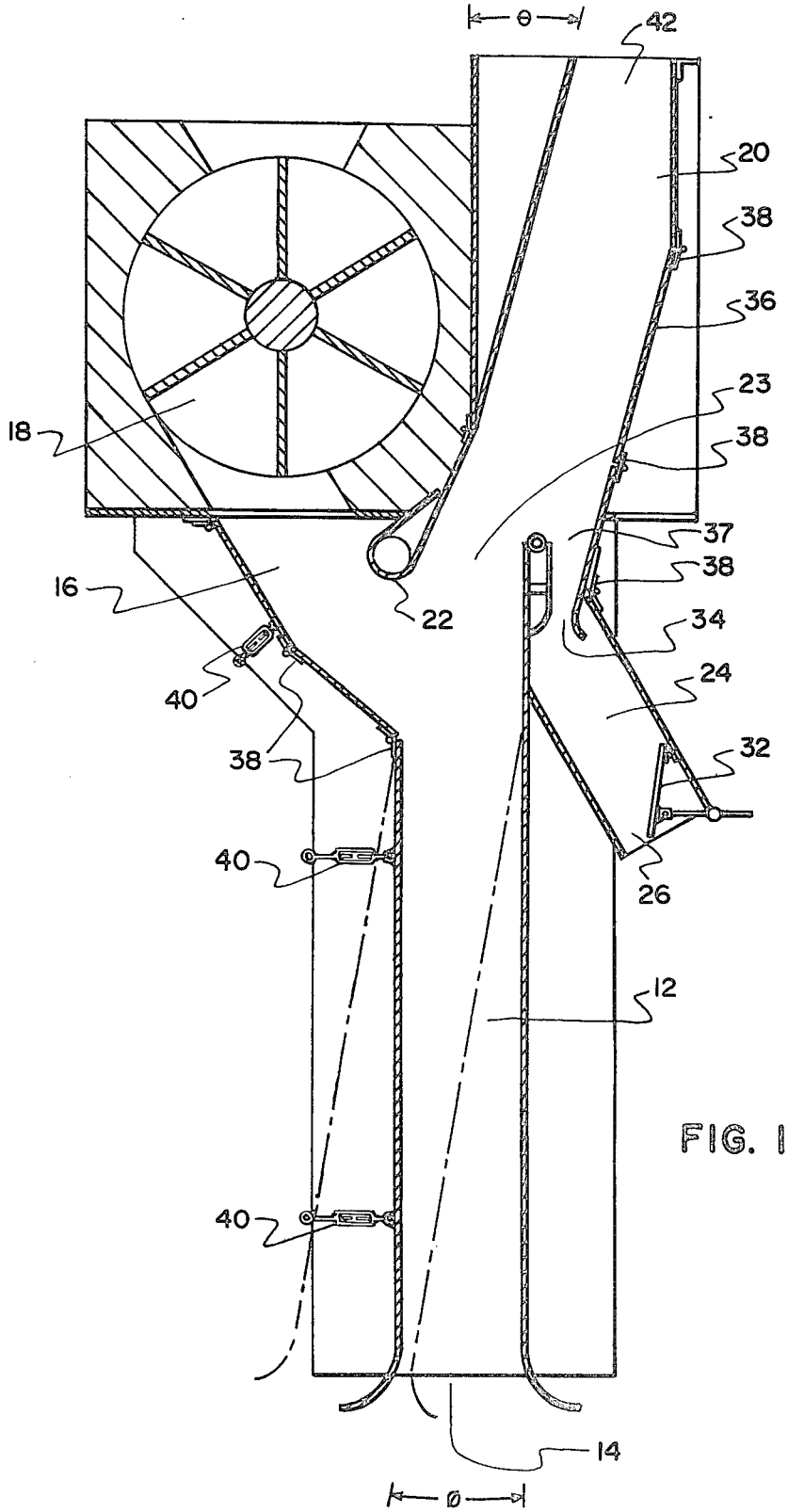
FIG. 1 is a sectional side elevation of the material separator.

Referring to FIG. 1, the preferred embodiment of the separator of the present invention has a generally vertical duct structure which includes an unobstructed, substantially straight primary duct 12, the base of which defines an output port 14. Opening into the primary duct 12 near the top is a material input duct 16. The primary duct 12 may be substantially vertical as shown by solid lines or may be inclined at an angle $\phi$ under the input duct 16 as shown by broken lines. Preferably the angle $\phi$ is not more than ten degrees from vertical and more preferably not more than five degrees. Conveniently, means are provided for introducing particulate material into the input duct 16 without allowing air to enter the duct. While such means may take a variety of forms, one suitable form is a rotary star feeder 18 as shown in FIG. 1.

Figure 2:
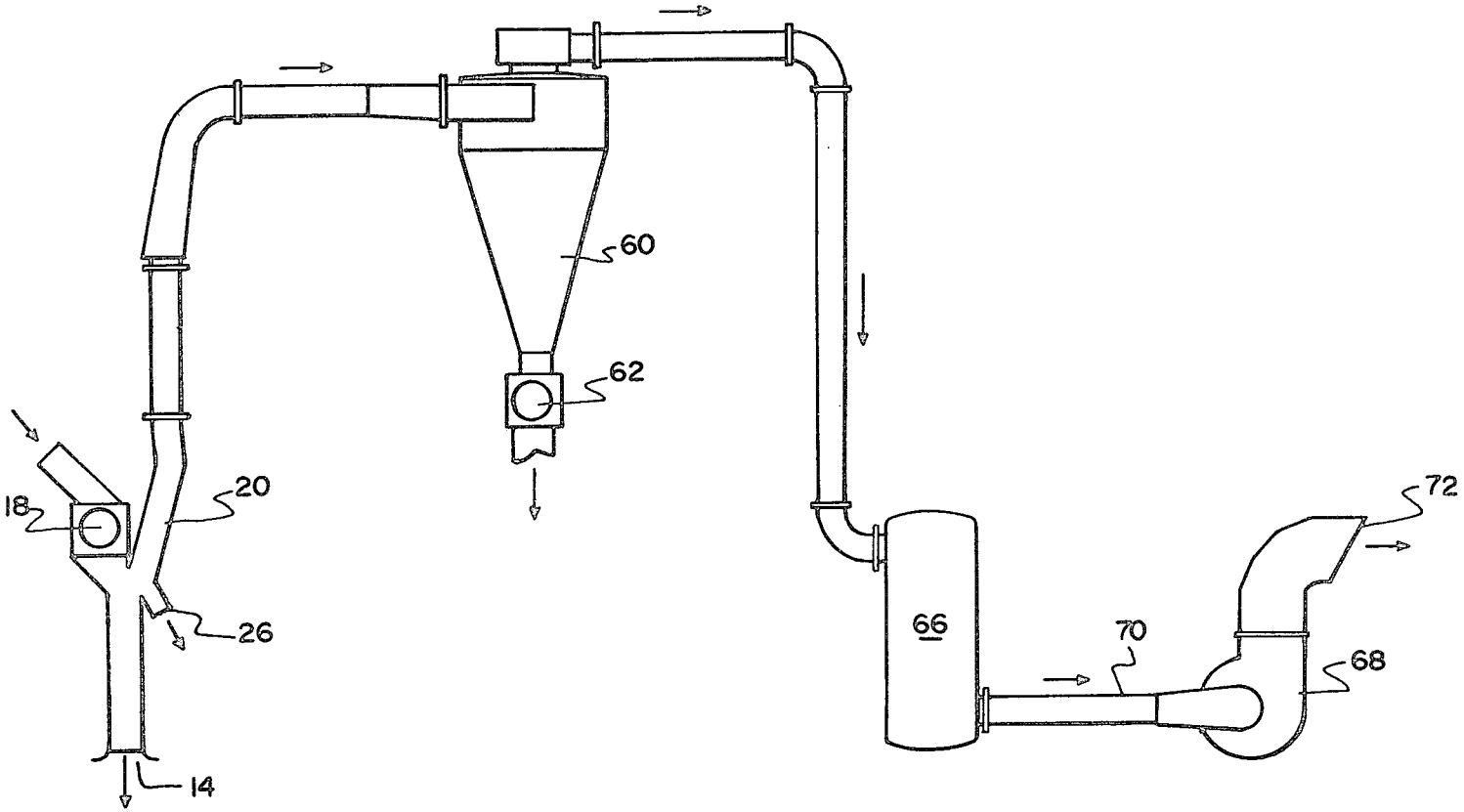
FIG. 2 is a schematic diagram showing the material separator of FIG. 1 incorporated as a part of a complete material separation system.

A secondary duct 24 is positioned adjacent to the primary duct 12. The width of the secondary duct is reduced near its top to form a venturi 34. Because the throat of this venturi is the narrowest portion of the secondary duct, the column of air moving through the secondary duct reaches maximum velocity as it passes through the venturi 34. This area of high velocity serves as a barrier to low density particles which might fall into the verturi 34. The secondary duct 24 is provided at its bottom with an output port for the removal of particulate material and could, optionally, be fitted with suitable discharge apparatus such as a rotary star discharge apparatus. An air inlet is provided to admit air into the secondary duct 24. In the embodiment of FIGS. 1 and 2 an orifice 26 is provided which serves as both the output port and the air inlet. Alternatively, the secondary duct 24 could include an air inlet and a separate output port such as an airlock discharge device. In either case a damper means may be provided to adjustably constrict said secondary sorting duct and thus regulate the flow of air through the inlet. One suitable damper means is the damper 32 shown in FIG. 1.

Both the primary duct 12 and the secondary duct 24 open into the bottom of a discharge duct 20. An airfoil 22 is provided at the junction of the material input duct 16 and the discharge duct 20 to reduce the turbulence of air flowing up through the primary duct 12 and into the discharge duct 20. In the preferred embodiment, the duct work includes a region 23 of reduced cross-sectional area near the top of the primary sorting duct so that the airflow and particulate material at that point are accelerated into the discharge duct 20. The discharge duct 20 includes a lower portion immediately above the ducts 12, 24 which is sized so that the velocity of air moving through such lower portion is less than the velocity of air moving through the primary duct 12. Because the velocity of air in the lower portion of the discharge duct 20 is reduced, the densest particles in the discharge duct can fall downwardly into the venturi 34 and thus be collected in the secondary duct 24. The lower portion of the discharge duct 20 is inclined over the secondary duct 24 at a small angle $\phi$ from vertical so that an outer wall 36 of the discharge duct serves as a steep ramp which empties into a funnel-shaped mouth 37 of the venturi 34. Preferably the angle $\phi$ is about five to fifteen degrees from vertical. It is desirable, but not essential, that the discharge duct 20 narrow in its upper regions, as illustrated in FIG. 1, so that the column of air bearing the lighter particles of the buoyant fraction accelerates upwardly when it enters the narrowed region.

In the illustrated embodiment, the side walls of the various ducts are movable so that the cross-sectional area of the ducts and thus the velocity of air flowing through the ducts may be adjusted. A plurality of hinges 38 may be provided for ease in moving the side walls. An adjustable means of support, such as turnbuckles 40 hold the walls in the desired position.

Means are also provided for producing upward moving columns of air in each of the various ducts. The columns are preferably produced by a single suction means adapted to cause a negative pressure in the discharge duct 20. In this preferred configuration the output port 14 and orifice 26 are open to the surrounding atmosphere. Alternatively, upward moving columns of air in the various ducts may be provided by blowers which move columns of air upward through the primary and secondary sorting ducts 12, 24 at elevated pressures or by any other suitable means for creating upward moving columns of air in those ducts.

OPERATION

In operation, a heterogeneous mixture of particulate material is fed into the material input duct 16 by the rotary star feeder 18. The material falls by gravity into the primary duct 12 where it encounters a first upward moving column of air. A dense residual fraction of the material continues to fall by gravity through the primary duct 12 and eventually through the output port 14. A conveyor, bin or other suitable means (not shown) may be provided beneath the output port 14 for collecting the residual fraction. The downward acceleration due to gravity of a buoyant fraction of the material is overcome by the upwardly moving column of air. This buoyant fraction is raised by the column to the region 23 and from there accelerated into the discharge duct 20.

The column of air carrying the buoyant fraction and a second column of air, moving upwardly in the secondary duct, merge as they enter the lower portion of the discharge duct 20. Because the cross-sectional area of the lower portion of the discharge duct 20 is large by comparison to the combined cross-sectional areas of the duct at the point 23 and the venturi 34, the merged column of air moves through the discharge duct 20 at a lower velocity than the column of air moving through the duct at the point 23, In order to collect particulate material in the secondary duct it is necessary that the cross-sectional areas of the discharge duct be set such that air moves through a region at the bottom of the duct at a velocity not greater than the velocity of air in the primary duct 12.

In this zone of decreased velocity, heavier particles of the buoyant fraction can no longer be supported by the moving column of air and will fall downwardly. Some of the heavier particles of the buoyant fraction fall against the outer wall 36 and, because the air flow will be slower there, may thereafter roll or slide down into the mouth 37 of the venturi 34. Other of the heavier particles fall directly into the funnel shaped mouth 37. Any of the heavier particles which fall back toward the point 23 are again raised on the high velocity column of air which enters the discharge duct 20 from the primary duct 12. Because the discharge duct 20 is inclined, the high velocity column of air carries most of these heavier particles to a position from which they can fall against the wall 36 or directly into the mouth 37. All of the particles which fall into the mouth 37 encounter a second column of air which flows upwardly through the venturi 34. The particles continue to fall to the bottom of the secondary duct 24 only if the downward gravitational force acting on the particles is sufficient to overcome the upward force of this second column of air. Those particles which succeed in falling to the bottom of the secondary duct 24 are thereafter discharged through the output port formed by the orifice 26. Those lighter particles of the buoyant fraction which are not accelerated downwardly by gravity when they enter the discharge duct 20 are instead carried up into the upper regions of the discharge duct 20 and thereafter through an upper output port 42.

The density and/or aerodynamic characteristics of particles which enter the secondary duct 24 may be regulated by the damper 32 which is adjustable to vary the flow of air through the throat of venturi 34. In order for material to fall into the secondary duct, it is necessary that the damper be adjusted so that the velocity of air moving upwardly through the venturi 34 is not substantially greater than the velocity of air moving in the primary duct. If it is desired that the secondary duct be used to collect a fraction of particulate material of a lesser average density than the material collected in the primary duct 12, the velocity of air moving through the venturi 34 is adjusted to be less than the velocity of air in the primary duct. To prevent lightweight particles from falling into the secondary duct 24, the velocity of air moving through the venturi 34 is adjusted to be not substantially less than the velocity of air moving through the lower portion of the discharge duct 20.

As previously described, the air velocities in the primary duct 12 and the discharge duct 20 may be varied by moving the side walls of those ducts. In the preferred embodiment of the invention the walls of those ducts are positioned so that the desired velocity ratios are achieved by adjusting the damper 32 to admit, through the secondary duct, about ten to twenty percent of the total amount of air moving through the entire system.

The present invention has been successfully used for the separation of rocks from wood chips. In this application, the materials to be separated are essentially of two densities only. For this reason the velocity of air in each column is adjusted to maximize the collection of rocks in both the primary and secondary ducts so that wood chips carried out of the discharge duct on the combined columns of air are substantially free of rocks. Tests using the improved materials separator of the present invention demonstrated a highly efficient removal of 0.25 inch diameter rocks from wood chips. The separator used for these tests had a primary duct 174 sq. in. in cross-sectional area, a discharge duct with a lower portion 234 sq. in. in cross-sectional area, and a venturi having a cross-sectional area of twenty-four sq. in. In each run, the discharge duct was inclined at five degrees from vertical and air moved through the venturi at a velocity of twenty to thirty feet per second. The results of several typical runs are listed in Table I.

TABLE I

| Run No. | Primary duct inclination | Air velocity in primary duct (ft/sec.) | Rocks Discharged (percent) Primary duct | Secondary duct | Total |
|---|---|---|---|---|---|
| 1 | 0° | 48.9 | 90.3 | 3.7 | 94.0 |
| 2 | 0° | 49.3 | 88.2 | 7.3 | 95.5 |
| 3 | 5° | 53.3 | 96.2 | 1.9 | 98.1 |
| 4 | 10° | 53.0 | 88.1 | 6.0 | 94.1 |

The separator of the present invention is also well suited for the primary separation of shredded municipal waste. When used for this purpose, the various ducts are preferably adjusted so that the columns of air in both the primary and secondary ducts and the discharge duct move upward at a velocity sufficient to raise lightweight materials such as paper and plastic which are generally combustible, but insufficient to raise heavier materials. At these conditions, the only particles which are collected in the secondary duct 24 are those particles of the dense residual fraction which instead of falling through the bottom of the primary sorting duct 12, are unintentionally accelerated into the bottom of discharge duct 20. As compared to single column separators of similar capacity, the capture of material in the secondary duct 20 of the illustrated embodiment accounts for an overall improvement in separation of approximately five to ten percent.

FIG. 2 illustrates separation apparatus embodying the present invention in a complete system for processing shredded waste. Except for the material separator embodying the present invention, all of the equipment illustrated is of standard design.

Shredded refuse is fed into the rotary airlock feed device 18 of the apparatus embodying the present invention. The residual fraction of material discharge from a separation apparatus at the output port 14 of the primary duct and/or the heavier particles of the buoyant fraction which are discharged from the orifice 26 of the secondary duct are collected by any suitable means. The lighter particles in the buoyant fraction are carried upwardly through the discharge duct 20 into a cyclone 60 which serves as a convenient separating means where the lightweight particulate materials are separated from the column of air. Other conventional devices for separating solid particles from a gas would serve equally well for the same purpose. The lightweight particles are discharged from the bottom of the cyclone via a suitable airlock discharge device 62 and thereafter collected and transported to any desired location. If the air moving through the system is contaminated by toxic gases or lightweight solids, such as dust or lint, which might be harmful to the environment, a suitable treatment apparatus, indicated at 66, may be installed in the system to scrub undesirable contaminents from the air. A blower 68 is the sole means for moving air through this preferred system. It draws air through the entire system by creating a negative pressure in the duct indicated at 70. Air passing through this system is discharged to the atmosphere from the outlet 72 of the blower. To achieve maximum flexibility and efficiency, the blower 68 should be adjustable to vary the flow of air through the system and be equipped with automatic controls to maintain the flow of air at a constant rate so that particles collected in the various ducts of the separation apparatus will be within a uniform range of densities.

Separating apparatus embodying the present invention may also be used in a closed system. In a closed system, environmental discharge is further reduced and/or gases other than air may be used to transport the particulate material. The complete system described above may be modified to a substantially closed system by returning gas from the outlet of the blower to the output port 14 and orifice 26 which serves as gas inlets of the sorting ducts.

While I have shown and described a preferred embodiment of my invention, it will be apparent to those skilled in the art that changes and modifications may be made without departing from my invention in its broader aspects. I therefore intend the appended claims to cover all such changes and modifications as fall within the true spirit and scope of my invention.

I claim:

1. Apparatus for penumatically separating fractions of a heterogeneous mixture of particulate material according to relative densities and/or aerodynamic properties comprising:

an unobstructed, substantially straight primary duct which is not inclined from vertical by more than about 10° and which narrows near the top to define a region of accelerating airflow;

airlock feed means for feeding all material to be separated into said primary duct at a location upstream of said region of accelerating airflow and without admitting a substantial amount of air into said primary duct;

a discharge duct communicating with the top of said primary duct and extending upwardly therefrom;

means for producing an upwardly moving column of air in said primary and discharge ducts having a velocity operable to raise a light fraction of said material while a heavy fraction falls to the bottom of said primary duct;

a secondary duct which is displaced horizontally from said primary duct and which communicates only with said discharge duct and the surrounding atmosphere so that said secondary duct provides an inlet for admitting a column of air directly, entirely from the surrounding atmosphere into the interior of said discharge duct at a location shortly downstream of said region of accelerating airflow, to increase the volume of air in said upwardly moving column of air in said discharge duct, and adjustable damper means operable to adjustably constrict said secondary duct for regulating the velocity of air moving through said discharge duct.

2. Apparatus of claim 1 wherein said secondary duct is positioned in relation to said discharge duct such that said column of air moving through said discharge duct moves in the same general direction as said column of air moving through said secondary duct so that said columns converge at a small acute angle, whereby minimum turbulence will occur at the region of convergence.

3. Apparatus of claim 1 wherein said secondary duct narrows to form a venturi adjacent the location where said discharge and secondary ducts connect so that minimum turbulence will occur at the region of convergence.

4. Apparatus of claim 1 wherein said airlock feed means comprises:

an airlock feeder;

a material input duct which connects said feeder with said primary duct; and airfoil means located at the junction of said material input duct and said primary duct to minimize the turbulence of air flowing upwardly through said primary duct into said region of accelerating airflow.

* * * * *

UNITED STATES PATENT AND TRADEMARK OFFICE

CERTIFICATE OF CORRECTION

PATENT NO. : 4,230,559

DATED : October 28, 1980

INVENTOR(S) : William C. Smith

It is certified that error appears in the above-identified patent and that said Letters Patent are hereby corrected as shown below:

Col. 2., Line 41:
Insert --a-- between "provide" and "separating"

Col. 3, Line 11:
Correct the spelling of "venturi"

Col. 3, Line 32:
Delete "sorting"

Col. 5, Line 65:
Delete "sorting"

Col. 6, Line 61, Claim 1:
Correct the spelling of "pneumatically"

Signed and Sealed this

*Twenty-first* Day of *April 1981*

[SEAL]

*Attest:*

RENE D. TEGTMEYER

*Attesting Officer*

*Acting Commissioner of Patents and Trademarks*